US010633983B2

(12) United States Patent
Barua et al.

(10) Patent No.: US 10,633,983 B2
(45) Date of Patent: Apr. 28, 2020

(54) AIRFOIL TIP GEOMETRY TO REDUCE BLADE WEAR IN GAS TURBINE ENGINES

(71) Applicant: General Electric Company, Schenectady, NY (US)

(72) Inventors: Ananda Barua, Schenectady, NY (US); Neelesh Nandkumar Sarawate, Niskayuna, NY (US); Kenneth Martin Lewis, Liberty Township, OH (US); Changjie Sun, Clifton Park, NY (US); Yu Xie Mukherjee, West Chester, OH (US); Sathyanarayanan Raghavan, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 395 days.

(21) Appl. No.: 15/063,048

(22) Filed: Mar. 7, 2016

(65) Prior Publication Data

US 2017/0254210 A1 Sep. 7, 2017

(51) Int. Cl.
*F01D 5/20* (2006.01)
*F01D 11/08* (2006.01)

(52) U.S. Cl.
CPC ..... *F01D 5/20* (2013.01); *F01D 11/08* (2013.01); *F05D 2230/10* (2013.01); *F05D 2240/307* (2013.01); *F05D 2250/75* (2013.01)

(58) Field of Classification Search
CPC ..... F01D 5/20; F01D 5/12; F01D 5/14; F01D 11/08; F05D 2220/32; F05D 2230/60; F05D 2240/14; F05D 2240/307; F05D 2220/3216; F04D 29/324; F04D 29/38; F04D 29/388
USPC ..... 415/173.1
See application file for complete search history.

(56) References Cited

U.S. PATENT DOCUMENTS 4,874,290 A 10/1989 Cang et al.
4,875,831 A * 10/1989 Fetiveau ..... F01D 5/20 416/228
5,018,942 A 5/1991 Ciokajlo et al.
5,048,183 A 9/1991 Cang et al.
5,476,363 A * 12/1995 Freling ..... F01D 5/20 205/110

(Continued)

OTHER PUBLICATIONS

Padova, Corso et al.; "Casing Treatment and Blade-Tip Configuration Effects on Controlled Gas Turbine Blade Tip/Shroud Rubs at Engine Conditions;" Journal of Turbomachinery; Jan. 2011; vol. 133, 12 pp.

(Continued)

*Primary Examiner* — Kenneth J Hansen
*Assistant Examiner* — Justin A Pruitt
(74) *Attorney, Agent, or Firm* — Armstrong Teasdale LLP

(57) ABSTRACT

An airfoil for use in a turbomachine includes a pressure sidewall and a suction sidewall coupled to the pressure sidewall. The suction sidewall and the pressure sidewall define a leading edge and a trailing edge, the leading edge and the trailing edge define a chord distance. The airfoil includes a tip portion extending between the pressure sidewall and the suction sidewall. The tip portion includes a planar section and a recessed section. The recessed section extends adjacent to the planar section such that a thickness of the planar section is less than a thickness of the airfoil. The recessed section is offset a predetermined distance from the leading edge and the trailing edge along the chord distance.

14 Claims, 5 Drawing Sheets

(56) References Cited

U.S. PATENT DOCUMENTS

| | | | | |
|---|---|---|---|---|
| 5,660,523 | A | 8/1997 | Lee | |
| 6,502,304 | B2 | 1/2003 | Rigney et al. | |
| 6,616,410 | B2 | 9/2003 | Grylls et al. | |
| 6,672,829 | B1 | 1/2004 | Cherry et al. | |
| 8,172,518 | B2 | 5/2012 | Ruehr et al. | |
| 8,657,570 | B2 | 2/2014 | Kray et al. | |
| 8,790,088 | B2 | 7/2014 | Dyer et al. | |
| 8,858,167 | B2 | 10/2014 | Baumann | |
| 9,114,496 | B2 | 8/2015 | Saunders et al. | |
| 2009/0269189 | A1 | 10/2009 | Bottome | |
| 2012/0034101 | A1 | 2/2012 | James et al. | |
| 2013/0142651 | A1 | 6/2013 | Lim | |
| 2013/0236325 | A1* | 9/2013 | Duong | F01D 5/141 416/236 R |
| 2013/0243596 | A1* | 9/2013 | Quach | F01D 5/187 416/92 |
| 2014/0044553 | A1* | 2/2014 | Geppert | F01D 5/20 416/243 |
| 2015/0204347 | A1 | 7/2015 | Strock et al. | |
| 2017/0167275 | A1* | 6/2017 | Schroeder | F01D 5/147 |

OTHER PUBLICATIONS

Padova, Corso et al.; "Experimental Results from Controlled Blade Tip/Shroud Rubs at Engine Speed;" Journal of Turbomachinery; Oct. 2007; vol. 129, 11 pp.

Papa, M. et al; "Effects of Tip Geometry and Tip Clearance on the Mass/Heat Transfer from a Large-Scale Gas Turbine Blade;" ASME Turbo Expo 2002: Power for Land, Sea and Air; Jun. 3-6, 2002; Amsterdam, The Netherlands; 10 pp.

* cited by examiner

AIRFOIL TIP GEOMETRY TO REDUCE BLADE WEAR IN GAS TURBINE ENGINES

BACKGROUND

The field of the disclosure relates generally to gas turbine engines and, more particularly, to airfoil tip geometry to reduce blade wear in gas turbine engines.

At least some known turbomachines, i.e., gas turbine engines, include a compressor that compresses air through a plurality of rotatable compressor blades enclosed within a compressor casing, and a combustor that ignites a fuel-air mixture to generate combustion gases. The combustion gases are channeled through rotatable turbine blades in a turbine through a hot gas path. Such known turbomachines convert thermal energy of the combustion gas stream to mechanical energy used to generate thrust and/or rotate a turbine shaft to power an aircraft. Output from the turbomachine may also be used to power a machine, such as, an electric generator, a compressor, or a pump.

Under some known operating conditions, rub events occur within the turbomachine, wherein a rotor blade tip contacts or rubs against the surrounding stationary casing inducing radial and tangential loads into a rotor blade airfoil. Generally during rub events, these loads induce the rotor blade to vibrate and deflect. Excessive tip rub events cause wear to the rotor blade including, but not limited to, loss of blade material and/or formation of tip fractures, which decrease turbomachine performance.

During tip rub events, the rotor blade is known to lose more material from the tip than the penetration distance into the casing. For example, if the blade tip penetrates the casing 1 mil (25.4 micrometers (μm)) then the blade tip is known to lose as much as 10 mils (254 μm) of material. The thickness of material lost in the blade tip divided by the penetration distance into the casing is known as a rub ratio. In the above example, the rub ratio would be 10:1, or known to have a rub ratio value of 10. Turbomachines with a high rub ratio are known to have decreased performance and decreased service life resulting in higher maintenance costs.

BRIEF DESCRIPTION

In one aspect, an airfoil for use in a turbomachine is provided. The airfoil includes a pressure sidewall and a suction sidewall coupled to the pressure sidewall. The suction sidewall and the pressure sidewall define a leading edge and a trailing edge, the leading edge and the trailing edge define a chord distance. The airfoil further includes a tip portion extending between the pressure sidewall and the suction sidewall. The tip portion includes at least one planar section and at least one recessed section. The at least one recessed section extends adjacent to the at least one planar section such that a thickness of the at least one planar section is less than a thickness of the airfoil. The at least one recessed section is offset a predetermined distance from the leading edge and the trailing edge along the chord distance.

In a further aspect, a turbomachine is provided. The turbomachine includes a casing, and a rotor assembly, the casing at least partially extending about the rotor assembly. The rotor assembly includes a rotor shaft, and a plurality of rotor blades coupled to the rotor shaft. Each rotor blade of the plurality of rotor blades includes an airfoil including a pressure sidewall and a suction sidewall coupled to the pressure sidewall. The suction sidewall and the pressure sidewall define a leading edge and a trailing edge, the leading edge and the trailing edge define a chord distance.

The airfoil further includes a tip portion extending between the pressure sidewall and the suction sidewall. The tip portion includes at least one planar section and at least one recessed section. The at least one recessed section extends adjacent to the at least one planar section such that a thickness of the at least one planar section is less than a thickness of the airfoil. The at least one recessed section is offset a predetermined distance from the leading edge and the trailing edge along the chord distance.

In another aspect, a method of assembling a turbomachine is provided. The turbomachine includes a casing, a rotor shaft, and a plurality of rotor blades. Each rotor blade of the plurality of rotor blades includes an airfoil including a pressure sidewall and a suction sidewall coupled to the pressure sidewall. The suction sidewall and the pressure sidewall define a leading edge and a trailing edge, the leading edge and the trailing edge define a chord distance. The airfoil further includes a tip portion extending between the pressure sidewall and the suction sidewall. The method includes forming at least one recessed section adjacent to at least planar section such that a thickness of the at least one planar section is less than a thickness of the airfoil. The at least one recessed section is offset a predetermined distance from the leading edge and the trailing edge along the chord distance. The method further includes coupling the rotor blade to the rotor shaft such that during turbomachine operation, when the tip portion contacts the casing, wear of the rotor blade is reduced.

DRAWINGS

These and other features, aspects, and advantages of the present disclosure will become better understood when the following detailed description is read with reference to the accompanying drawings in which like characters represent like parts throughout the drawings, wherein.

Figure 1:
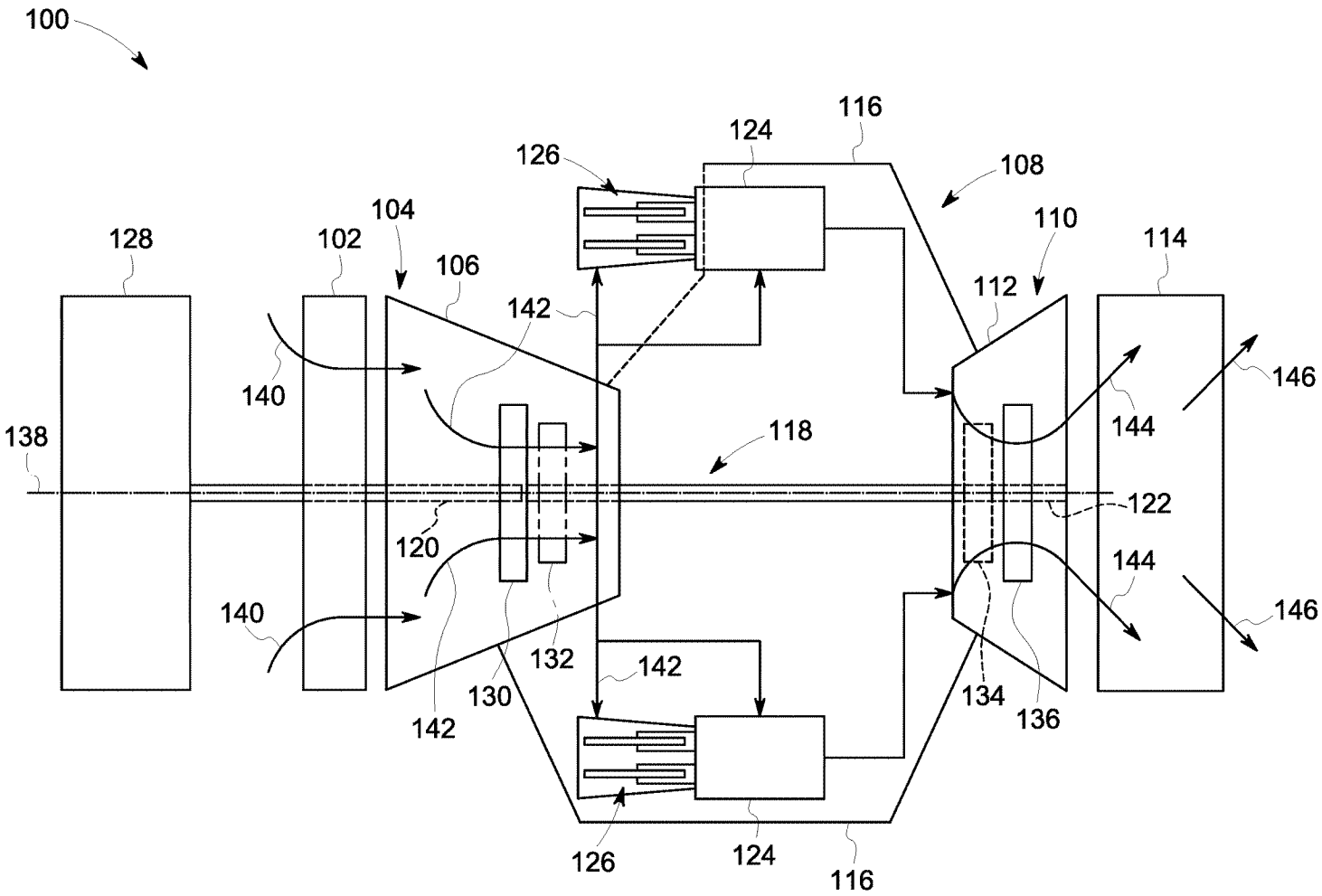
FIG. 1 is a schematic diagram of an exemplary turbomachine, i.e., a turbofan.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Rotor blade tip geometries as described herein provide a method for reducing blade wear in a turbomachine. Specifically, a rotor blade includes an airfoil having a suction sidewall coupled to a pressure sidewall at a leading edge and a trailing edge. A tip portion extends between the suction sidewall and the pressure sidewall and includes a planar section and a recessed section. In some embodiments, the tip portion includes a first recessed section and a second recessed section. Modifying the rotor blade tip geometry by forming the recessed section reduces the rub ratio of the rotor blade, and thereby, the wear of the rotor blade. Specifically, the recessed section is sized such that a contact area between the rotor blade and a surrounding casing is reduced, thereby decreasing the radial and tangential loads induced into the rotor blade during a rub event. Reducing the loads resulting from a rub event decreases vibration and deflection of the rotor blade and reduces material loss at the tip portion. Furthermore, modifying the rotor blade tip geometry changes the vibratory modes of the rotor blade such that radial elongation is decreased further reducing material loss at the tip portion. Additionally, a reduction in radial deflection allows the rotor blade to be positioned closer to the surrounding casing. Accordingly, decreasing the rub ratio of the rotor blade decreases wear and material loss during a rub event, increases turbomachine performance, and reduces maintenance costs.

As used herein, the terms "axial", and "axially", refer to directions and orientations which extend substantially parallel to a centerline 138, as shown in FIG. 1, of a turbine engine. Moreover, the terms "radial", and "radially", refer to directions and orientations which extend substantially perpendicular to centerline 138 of the turbine engine. In addition, as used herein, the terms "circumferential", and "circumferentially", refer to directions and orientations which extend arcuately about centerline 138 of the turbine engine. The term "fluid", as used herein, includes any medium or material that flows, including, but not limited to, air.

FIG. 1 is a schematic view of a turbomachine 100, i.e., a gas turbine engine, and more specifically, an aircraft engine or turbofan. In the exemplary embodiment, turbomachine 100 includes an air intake section 102, and a compressor section 104 that is coupled downstream from, and in flow communication with, intake section 102. Compressor section 104 is enclosed within a compressor casing 106. A combustor section 108 is coupled downstream from, and in flow communication with, compressor section 104, and a turbine section 110 is coupled downstream from, and in flow communication with, combustor section 108. Turbine section 110 is enclosed within a turbine casing 112 and includes an exhaust section 114 that is downstream from turbine section 110. A combustor housing 116 extends about combustor section 108 and is coupled to compressor casing 106 and turbine casing 112. Moreover, in the exemplary embodiment, turbine section 110 is coupled to compressor section 104 through a rotor assembly 118 that includes, without limitation, a compressor rotor, or drive shaft 120 and a turbine rotor, or drive shaft 122.

In the exemplary embodiment, combustor section 108 includes a plurality of combustor assemblies, i.e., combustors 124 that are each coupled in flow communication with compressor section 104. Combustor section 108 also includes at least one fuel nozzle assembly 126. Each combustor 108 is in flow communication with at least one fuel nozzle assembly 126. Moreover, in the exemplary embodiment, turbine section 110 and compressor section 104 are rotatably coupled to a fan assembly 128 through drive shaft 120. Alternatively, turbomachine 100 may be a gas turbine engine and for example, and without limitation, be rotatably coupled to an electrical generator and/or a mechanical drive application, e.g., a pump. In the exemplary embodiment, compressor section 104 includes at least one compressor stage that includes a compressor blade assembly 130 and an adjacent stationary stator vane assembly 132. Each compressor blade assembly 130 includes a plurality of circumferentially spaced blades (not shown) and is coupled to rotor assembly 118, or, more specifically, compressor drive shaft 120. Each stator vane assembly 132 includes a plurality of circumferentially spaced stator vanes (not shown) and is coupled to compressor casing 106. Also, in the exemplary embodiment, turbine section 110 includes at least one turbine blade assembly 134 and at least one adjacent stationary nozzle assembly 136. Each turbine blade assembly 134 is coupled to rotor assembly 118, or, more specifically, turbine drive shaft 122 along a centerline 138.

In operation, air intake section 102 channels air 140 towards compressor section 104. Compressor section 104 compresses air 140 to higher pressures and temperatures prior to discharging compressed air 142 towards combustor section 108. Compressed air 142 is channeled to fuel nozzle assembly 126, mixed with fuel (not shown), and burned within each combustor 124 to generate combustion gases 144 that are channeled downstream towards turbine section 110. After impinging turbine blade assembly 134, thermal energy is converted to mechanical rotational energy that is used to drive rotor assembly 118. Turbine section 110 drives compressor section 104 and/or fan assembly 128 through drive shafts 120 and 122, and exhaust gases 146 are discharged through exhaust section 114 to the ambient atmosphere.

Figure 2:
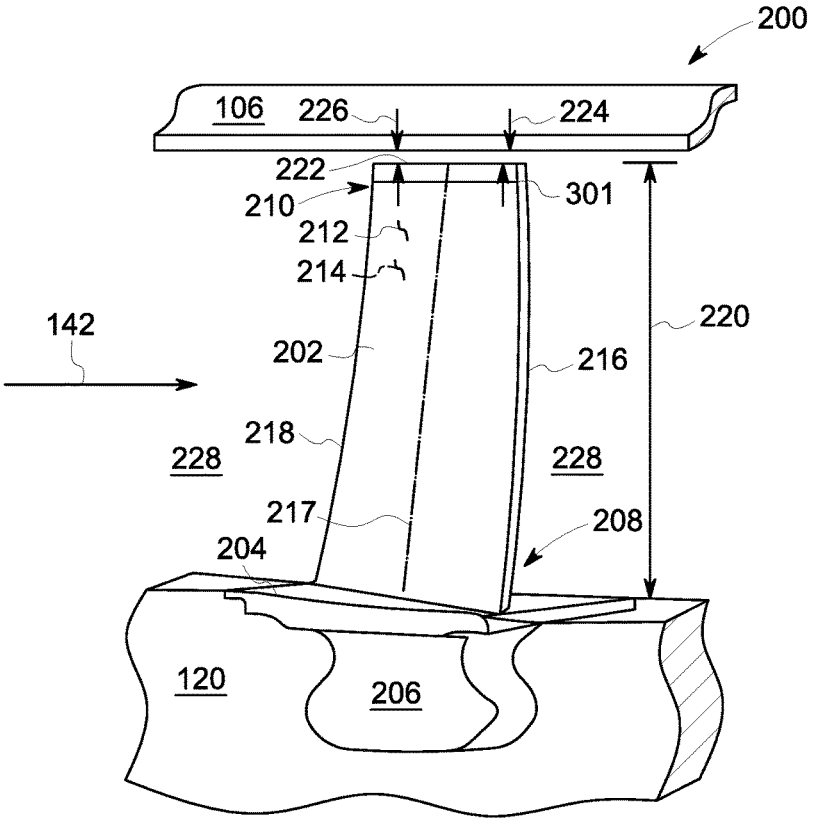
FIG. 2 is a perspective view of an exemplary blade that may be used within the turbomachine shown in FIG. 1.

FIG. 2 is a perspective view of an exemplary rotor blade 200, and more specifically, a compressor blade, that may be found within turbomachine 100 (shown in FIG. 1). In the exemplary embodiment, rotor blade 200 includes an airfoil 202, a platform 204, and a dovetail 206 that is used for mounting rotor blade 200 to compressor drive shaft 120 (shown in FIG. 1). Airfoil 202 includes a root portion 208, adjacent platform 204, and an opposite tip portion 210. Further, airfoil 202 includes a pressure sidewall 212 and an opposite suction sidewall 214. In the exemplary embodiment, pressure sidewall 212 is substantially concave and suction sidewall 214 is substantially convex. Pressure sidewall 212 is coupled to suction sidewall 214 at a leading edge 216 and at an axially spaced trailing edge 218. Trailing edge 218 is spaced chord-wise and downstream from leading edge 216. Pressure sidewall 212 and suction sidewall 214 each extend longitudinally or radially outward in a length 220 from root portion 208 to blade tip portion 210. Along a chord of blade 200, a mid-chord line 217 is defined at the mid-point of the chord. Tip portion 210 is defined between sidewalls 212 and 214 and includes a planar section 222 that is defined as the radially outer surface of blade 200 and substantially perpendicular to each sidewall 212 and 214. Tip portion 210 also includes a recessed section 301 extending between planar section 222 and pressure sidewall 212 and described further below in reference to FIG. 3. In an alternative embodiment, rotor blade 200 may have any other configuration that enables turbomachine to function as described herein.

In the exemplary embodiment, compressor casing 106 circumferentially extends around rotor blade 200, and tip portion 210. Specifically, tip portion 210 at leading edge 216 has a gap distance 224 that is substantially equal to a gap distance 226 of tip portion 210 at trailing edge 218. Furthermore, a flow path 228 for compressed air 142 (shown in FIG. 1) is defined between compressor casing 106 and shaft 120.

During operation, rotor blade 200 rotates within casing 106 about centerline 138 (shown in FIG. 1). In some operating conditions, such as an imbalanced load, rotor blade 200, specifically tip portion 210, contacts or rubs against casing 106, which is also known as a rub event. Specifically, tip portion 210 is jammed into casing 106, such that radial and tangential loads are induced into rotor blade 200. Generally during rub events, these loads cause rotor blade 200 to vibrate and deflect causing wear thereto. The deflection of rotor blade 200, at least in part, depends on the vibratory modes of the blade that are excited during the rub event. Some vibratory modes are known to increase radial elongation of rotor blade 200 resulting in an increased amount of wear to tip portion 210.

At least some of the wear rotor blade 200 incurs during the rub event includes material loss from tip portion 210. Specifically, when tip portion 210 contacts casing 106, rotor blade 200 loses material at tip portion 210 such that overall length 220 is reduced. A rub ratio is a value that may be used to quantify the amount of wear rotor blade 200 experiences during the rub event. A rub ratio is defined as a thickness of material lost from tip portion 210 during a rub event divided by an amount of penetration by tip portion 210 into casing 106. For example, if tip portion 210 penetrates into the casing 1 mil (25 μm) and 10 mils (101 μm) of blade material is lost from tip portion 210, the rub ratio is 10.

Figure 3:
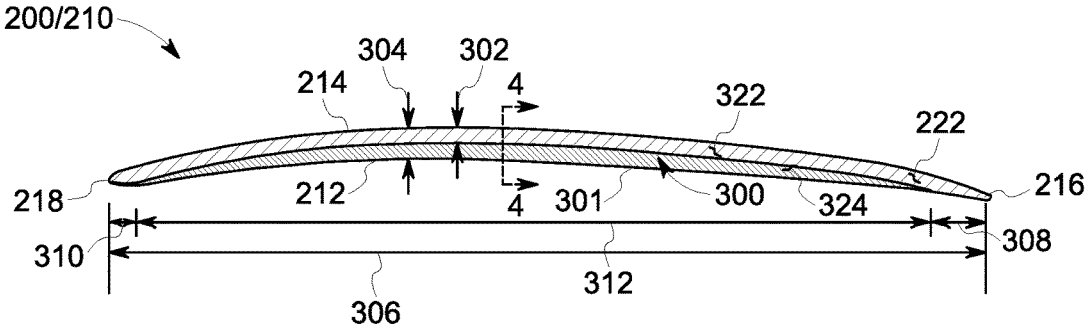
FIG. 3 is a top view of an exemplary blade tip of the blade shown in FIG. 2.
Figure 4:
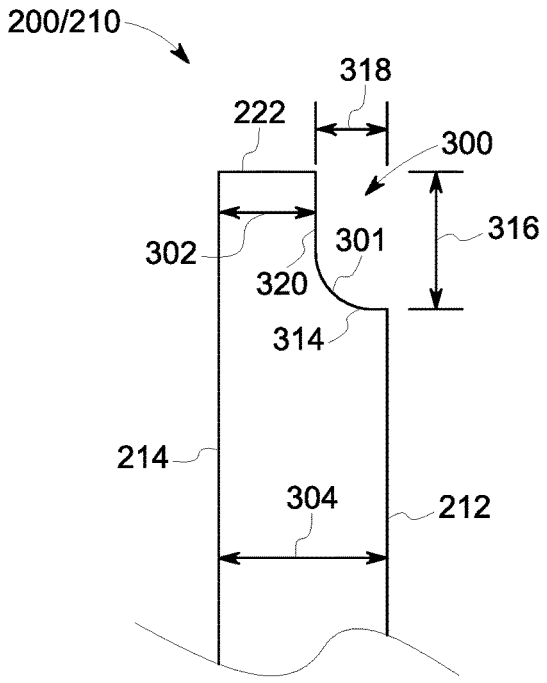
FIG. 4 is a cross-sectional view of the blade tip shown in FIG. 3 taken along line 4-4 shown in FIG. 3.

FIG. 3 is a top view of an exemplary tip portion 210 for use with rotor blade 200. FIG. 4 is a cross-sectional view of tip portion 210 shown in FIG. 3 taken along line 4-4 shown in FIG. 3. Referring to FIGS. 3 and 4, tip portion 210 includes recessed section 301, defining a recess 300, extending between planar section 222 and pressure sidewall 212 such that a "squealer tip" is formed to facilitate reduced wear of tip portion 210 during a rub event. Specifically, planar section 222 has a thickness 302 that is less than a thickness 304 of blade 200. In the exemplary embodiment, planar section 222 has a uniform thickness 302 of approximately 17 mils (440 μm) along a chord distance 306 that extends from leading edge 216 and trailing edge 218. With a uniform thickness 302 of planar section 222, recessed section 301 begins at an offset distance 308 from leading edge 216, and ends an offset distance 310 from trailing edge 218 such that recessed section 301 extends a length 312 in the chord direction that is substantially less than overall blade chord distance 306. In some embodiments, offset distances 308 and 310 are within a range between and including approximately 5% and approximately 40% of chord distance 312. For example, in particular embodiments, offset distances 308 and 310 are within a range between and including approximately 15% and approximately 30% of chord distance 312. In alternative embodiments, recessed section 301 is formed adjacent to leading edge 216 such that recessed section 301 is between mid-chord line 217 (shown in FIG. 2) and leading edge 216, or recessed section 301 is formed adjacent to trailing edge 218 such that recessed section 301 is between mid-chord line 217 and trailing edge 218.

In the exemplary embodiment, recessed section 301 is formed on pressure sidewall 212 and has a convex shape 314. Specifically, recessed section 301 extends a depth 316 from planar section 222 to root portion 208 (shown in FIG. 2). In the exemplary embodiment, depth 316 is within a range from approximately 30 mils (0.8 millimeters (mm)) to approximately 40 mils (1 mm). In particular embodiments, depth 316 is approximately 35 mils (0.9 mm). In alternative embodiments, depth 316 may have any other distance that enables tip portion 210 to function as described herein. Furthermore, recessed section 301 has a thickness 318 that is variable along blade chord distance 306 such that thickness 302 of planar section 222 is constant as described further above. Recessed section 301 also has a sidewall section 320 that is substantially parallel to suction sidewall 214. In alternative embodiments, recessed section 301 may be formed within suction sidewall 214.

Recessed section 301 facilitates reducing rotor blade 200 tip wear during a rub event. Specifically, recessed section 301 lowers the contact area between tip portion 210 and casing 106 (shown in FIG. 2) thereby reducing loads induced into rotor blade 200. In the exemplary embodiment, a cross-sectional area 322 of planar section 222 is less than a cross-sectional area 324 of blade 200. Specifically, cross-sectional area 322 is within a range between and including approximately 40% and approximately 70% less than cross-sectional area 324. In particular embodiments, cross-sectional area 322 is approximately 55% less than cross-sectional area 324. By reducing the radial and tangential loads induced into rotor blade 200, vibration and deflection are reduced, thereby reducing radial elongation of rotor blade 200. Additionally, modifying the geometry of tip portion 210 also modifies the vibratory modes that contribute to radial elongation within blade 200.

In the exemplary embodiment, recess 300 is formed by grinding tip portion 210 and removing rotor blade 200 material in a machine shop using known machining techniques. Alternatively, recess 300 can be formed by any other method that enables rotor blade 200 to function as described herein.

Figure 5:
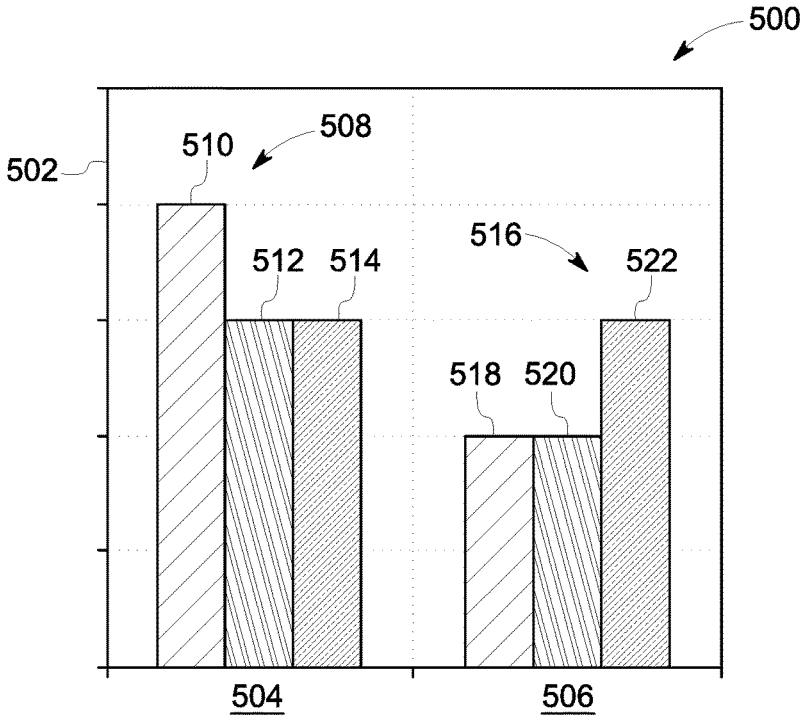
FIG. 5 is a graphical view of operational features of the blade tip shown in FIGS. 3 and 4.

FIG. 5 is a graphical view, i.e., chart 500, of the operational features of tip portion 210 shown in FIGS. 2-4. Specifically, chart 500 illustrates a rub ratio value for two different tip geometries of tip portion 210 (shown in FIG. 4). The rub ratio is defined as a thickness of material lost from tip portion 210 during a rub event divided by an amount of penetration by tip portion 210 into casing 106 as described in reference to FIG. 2. Chart 500 includes a y-axis 502 defining the rub ratio value on a unitless linear scale. Along the x-axis, two different tip geometries are shown: a baseline geometry 504, which includes planar section 222 (shown in FIG. 2) that extends the full length of tip portion 210 from leading edge 216 (shown in FIG. 2) to trailing edge 218 (shown in FIG. 2); and a first geometry 506, which includes recess 300 (shown in FIG. 4) within pressure sidewall 212 (shown in FIG. 4).

In the exemplary chart 500, each tip geometry 504 and 506 is subjected to a rub event with casing 106 (shown in FIG. 1) a thickness of material loss at each of leading edge 216, mid-chord line 217 (shown in FIG. 2), and trailing edge 218 are recorded. Then the rub ratio at each leading edge 216, mid-chord line 217, and trailing edge 218 are determined. Chart 500 includes a first group of bars 508 that represents the rub ratio for tip portion 210 with baseline geometry 504. A leftmost bar 510 represents that the rub ratio at leading edge 216 of baseline geometry 504, a middle bar 512 represents the rub ratio at mid-chord line 217, and a rightmost bar 514 represents the rub ratio at trailing edge 218.

Further, in the exemplary chart 500, a second group of bars 516 represents the rub ratio for tip portion 210 with first tip geometry 506. A leftmost bar 518 represents the rub ratio at leading edge 216, a middle bar 520 represents the rub ratio at mid-chord line 217, and a rightmost bar 522 represents the rub ratio at trailing edge 218. At leading edge 216 and mid-chord line 217 the rub ratio is lower than baseline geometry 504 and at trailing edge 218 the rub ratio is approximately equal to baseline geometry 504, shown with the first group of bars 508, thereby reducing wear of tip portion 210 during a rub event.

As shown in chart 500, modifying the geometry of tip portion 210 and forming a recess, such as recess 300 into tip portion 210, reduces the wear of rotor blade 200 (shown in FIG. 2) when compared to baseline geometry 504 without recess 300. Specifically, modifying tip portion 210 geometry reduces the rub ratio of blade 200. For example, recessed section 301 within tip portion 210 alters the way in which blade 200 contacts casing 106 during a rub event. Recessed section 301 lowers the contact force between rotor blade 200 and casing 106 thereby reducing vibration and deflection. By reducing the radial and tangential loads induced into rotor blade 200, vibration is reduced, thereby reducing radial elongation of rotor blade 200. Additionally, modifying the geometry of tip portion 210 also modifies the vibratory modes that contribute to radial elongation within blade 200. Reducing radial elongation within rotor blade 200 decreases the amount of material loss due to rubbing against casing 106 and thus wear of rotor blade 200. In alternative embodiments, modifying the geometry of tip portion 210 results in different rub ratio values of blade 200 then illustrated in chart 500.

In the embodiments described above and referencing FIGS. 1-4, rotor blade is shown and described as a compressor blade. Within compressor section 104, each compressor stage may incorporate rotor blades 200 that include different recesses 300. For example, a first compressor stage includes a plurality of rotor blades 200 with tip portion 210 having recessed section 301 with offset distance 308 extending approximately 15% of chord distance 306, while a second compressor stage includes a plurality of rotor blades 200 with tip portion 210 having recessed section 301 with offset distance 308 extending approximately 30% of chord distance 306. Moreover, in alternative embodiments, tip portion 210 having recessed section 301, is in any other blade within turbomachine 100, such as, in turbine section 112.

Figure 6:
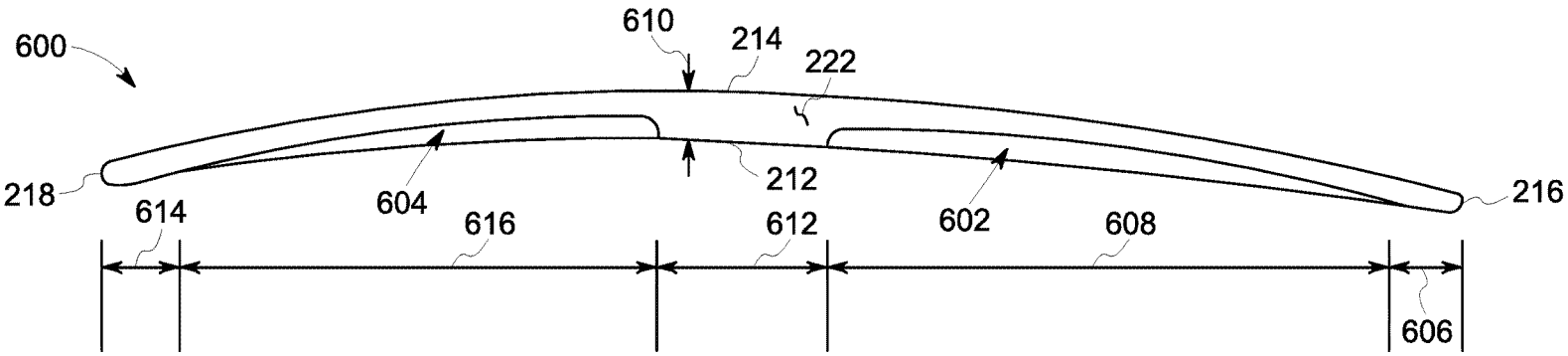
FIG. 6 is a top view of an alternative blade tip that may be used with the blade shown in FIG. 2.

FIG. 6 is a top view of an alternative tip portion 600 for use with rotor blade 200 (shown in FIG. 2). In this alternative embodiment, rotor blade 200 includes pressure sidewall 212 and an opposing suction sidewall 214 which extend from root portion 208 (shown in FIG. 2) to tip portion 600. Additionally, tip portion 600 includes a first recessed section 602 and a second recessed section 604 formed between planar section 222 and pressure sidewall 212. First recessed section 602 is offset 606 from leading edge 216 and extends towards trailing edge 218 for a length 608 such that planar section 222 has a thickness 610 for a length 612 about mid-chord line 217 (shown in FIG. 2) that is substantially equal to blade thickness 304 (shown in FIG. 3). Second recessed section 604 is offset 614 from trailing edge 218 and extends toward leading edge 216 for a length 616. In this alternative embodiment, first recessed section length 608 and second recessed section length 616 are substantially equal. In some embodiments, first recessed section length 608 and second recessed section length 616 are not equal.

Similar to tip portion 210 (shown in FIG. 3), tip portion 600 reduces the rub ratio of rotor blade 200. First and second recessed sections 602 and 604 reduces the cross-sectional area of tip portion 600 thereby lowering the contact force between rotor blade 200 and casing 106 (shown in FIG. 2) and reducing radial elongation. Reducing radial elongation within rotor blade 200 decreases the amount of material loss due to rubbing against casing 106 and thus wear of blade 200.

Figure 7:
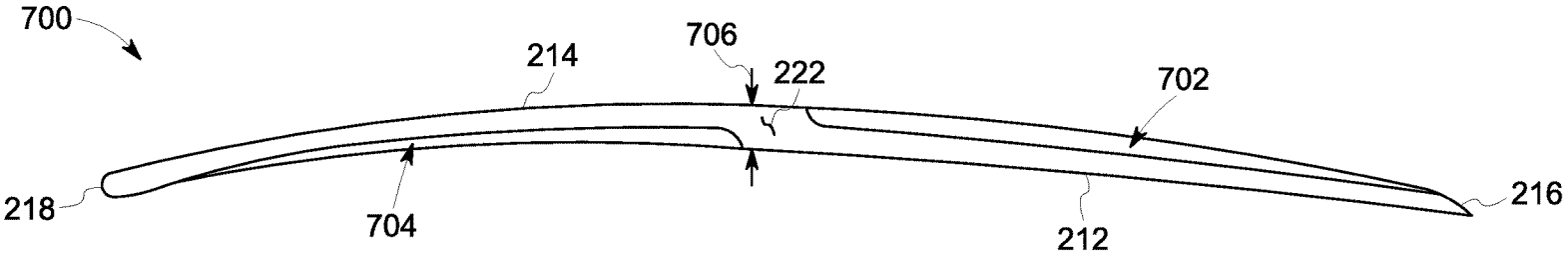
FIG. 7 is a top view of another alternative blade tip that may be used with the blade shown in FIG. 2.

FIG. 7 is a tip view of another alternative tip portion 700 for use with rotor blade 200 (shown in FIG. 2). In this alternative embodiment, rotor blade 200 includes pressure sidewall 212 and an opposing suction sidewall 214 which extend from root portion 208 (shown in FIG. 2) to tip portion 700. Additionally, tip portion 700 includes a first recessed section 702 and a second recessed section 704. First recessed section 702 is formed between planar section 222 and suction sidewall 214 such that first recessed section 702 is along suction sidewall 214. Second recessed section 704 is formed between planar section 222 and pressure sidewall 212 such that second recessed section 704 is along pressure sidewall 212, the opposite sidewall of first recessed section 704. In this alternative embodiment, planar section 222 has a thickness 706 adjacent to mid-chord line 217 (shown in FIG. 2) that is substantially equal to blade thickness 304 (shown in FIG. 3).

Similar to tip portion 210 (shown in FIG. 3), tip portion 700 reduces the rub ratio of rotor blade 200. First and second recessed sections 702 and 704 reduces the cross-sectional area of tip portion 700 thereby lowering the contact force between rotor blade 200 and casing 106 (shown in FIG. 2) and reducing radial elongation. Reducing radial elongation within rotor blade 200 decreases the amount of material loss due to rubbing against casing 106 and thus wear of blade 200.

Figure 8:
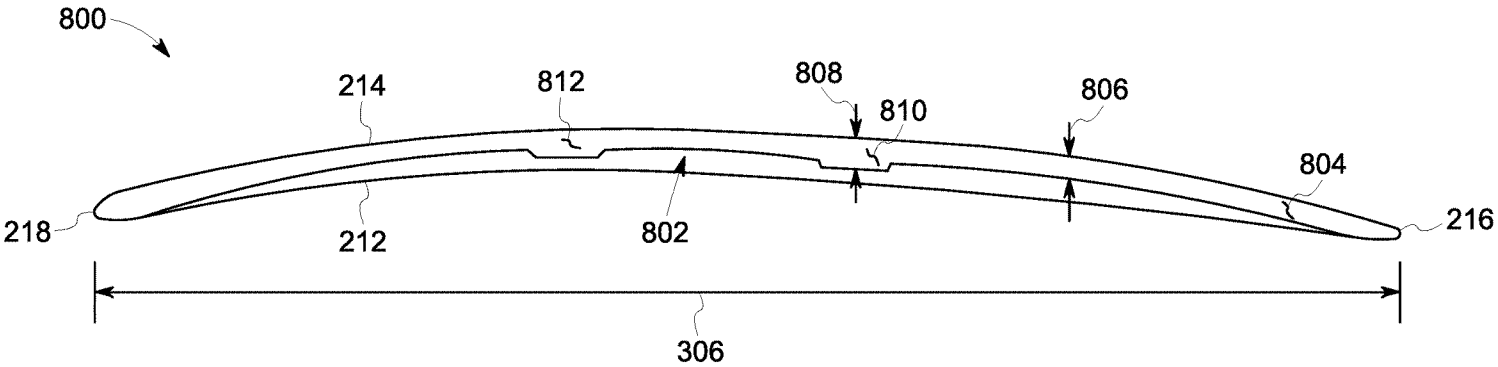
FIG. 8 is a top view of a further alternative blade tip that may be used with the blade shown in FIG. 2.

FIG. 8 is a tip view of a further alternative tip portion 800 for use with rotor blade 200 (shown in FIG. 2). In this alternative embodiment, rotor blade 200 includes pressure sidewall 212 and an opposing suction sidewall 214 which extends from root portion 208 (shown in FIG. 2) to tip portion 800. Additionally, tip portion 800 includes a recessed section 802 formed between planar section 804 and pressure sidewall 212. Planar section 804 has a first thickness 806 along a portion of chord distance 306 and a second thickness 808 along a portion of chord distance 306. Each thickness 806 and 808 is substantially not equal to rotor blade thickness 304 (shown in FIG. 3). In this alternative embodiment, first thickness 806 is not equal to second thickness 808. As shown in FIG. 8, planar section 804 has two locations 810 and 812 with second thickness 808. In alternative embodiments, planar section 804 has any other number of locations, such as, but not limited to, 1, 3, 4, and 5 with second thickness 808 that enables tip portion 800 to function as described herein. Furthermore, the thickness at each location 810 and 812 may be substantially not equal.

Similar to tip portion 210 (shown in FIG. 3), tip portion 800 reduces the rub ratio of rotor blade 200. Planar section 804 with recessed section 802 reduces the cross-sectional area of tip portion 800 thereby lowering the contact force between rotor blade 200 and casing 106 (shown in FIG. 2) and reducing radial elongation. Reducing radial elongation within rotor blade 200 decreases the amount of material loss due to rubbing against casing 106 and thus wear of blade 200.

Figure 9:
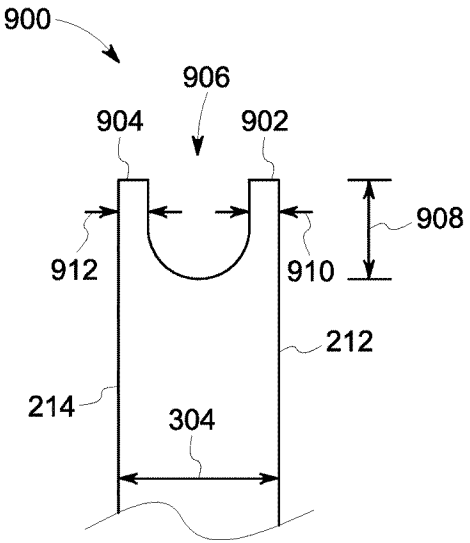
FIG. 9 is a cross-sectional view of yet another alternative blade tip that may be used with the blade shown in FIG. 2.

FIG. 9 is a cross-sectional view of yet another alternative tip portion 900 for use with rotor blade 200 (shown in FIG. 2). In this alternative embodiment, rotor blade 200 includes pressure sidewall 212 and an opposing suction sidewall 214 which extend from root portion 208 (shown in FIG. 2) to tip portion 900. Additionally, tip portion 900 includes a first planar section 902 adjacent to pressure sidewall 212 and a section planar section 904 adjacent to suction sidewall 214. A recessed section 906 is formed between first and second planar section 902 and 904 and extends a depth 908 within blade 200. Specifically, recessed section 906 is substantially U-shaped forming a thickness 910 at tip portion pressure sidewall 212 and a thickness 912 at tip portion pressure sidewall 214. Thicknesses 910 and 912 when combined are less then blade thickness 304.

Similar to tip portion 210 (shown in FIG. 3), tip portion 900 reduces the rub ratio of rotor blade 200. U-shaped recessed section 906 reduces the cross-sectional area of tip portion 900 thereby lowering the contact force between rotor blade 200 and casing 106 (shown in FIG. 2) and reducing radial elongation. Reducing radial elongation within rotor blade 200 decreases the amount of material loss due to rubbing against casing 106 and thus wear of blade 200.

The above described rotor blade tip geometries reduces wear in a turbomachine. Specifically, a rotor blade includes an airfoil having a suction sidewall coupled to a pressure sidewall at a leading edge and a trailing edge. A tip portion extends between the suction sidewall and the pressure sidewall and includes a planar section and a recessed section. In some embodiments, the tip portion includes a first recessed section and a second recessed section. Modifying the rotor blade tip geometry by forming the recessed section reduces the rub ratio of the rotor blade and, thereby, the wear of the rotor blade. Specifically, the recessed section is sized such that a contact area between the rotor blade and a surrounding casing is reduced, thereby decreasing the radial and tangential loads induced into the rotor blade during a rub event. Reducing the loads resulting from a rub event decreases vibration and deflection of the rotor blade and reduces material loss at the tip portion. Furthermore, modifying the rotor blade tip geometry changes the vibratory modes of the rotor blade such that radial elongation is decreased further reducing material loss at the tip portion. Additionally, a reduction in radial deflection allows the rotor blade to be positioned closer to the surrounding casing. Accordingly, decreasing the rub ratio of the rotor blade decreases wear and material loss during a rub event, increases turbomachine performance, and reduces maintenance costs.

An exemplary technical effect of the methods, systems, and apparatus described herein includes at least one of the following: (a) reducing wear of the rotor blade tip during a rub event with a surrounding casing; (b) decreasing a clearance gap between the rotor blade and the casing; (c) reducing maintenance costs of turbomachines; and (d) increasing turbomachine performance.

Exemplary embodiments of methods, systems, and apparatus for reducing rotor blade tip wear are not limited to the specific embodiments described herein, but rather, components of systems and/or steps of the methods may be utilized independently and separately from other components and/or steps described herein. Further, the methods, systems, and apparatus may also be used in combination with other systems requiring decreasing wear from a rub event, and the associated methods are not limited to practice with only the systems and methods described herein. Rather, the exemplary embodiment can be implemented and utilized in connection with many other applications, equipment, and systems that may benefit from reducing wear on a blade tip.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An airfoil for use in a turbomachine, said airfoil comprising:

a pressure sidewall;

a suction sidewall coupled to said pressure sidewall, wherein said suction sidewall and said pressure sidewall define a leading edge and a trailing edge, wherein said leading edge and said trailing edge define a chord distance; and a tip portion extending between said pressure sidewall and said suction sidewall, said tip portion comprising at least one planar section, said at least one planar section comprising a first section having a first thickness and a second section having a second thickness, wherein the second thickness is substantially equal to a thickness of said airfoil, said second section located at or about a mid-chord distance between and distanced from said leading edge and said trailing edge, said first section defining at least one recessed section, said at least one recessed section extending between said at least one planar section and said suction sidewall such that said pressure sidewall extends to said at least one planar section, said at least one recessed section offset from said leading edge and said trailing edge along the chord distance, wherein the first thickness is less than the second thickness.

2. The airfoil in accordance with claim 1, wherein a cross-sectional area of said planar section is within a range of between and including approximately 40% and approximately 70% less than a cross-sectional area of said airfoil and configured to reduce a contact area of said tip portion and a surrounding casing to decrease airfoil wear during contact with the surrounding casing.

3. The airfoil in accordance with claim 1, wherein said at least one recessed section is offset from said leading edge within a range between and including approximately 15% and approximately 30% of the chord distance.

4. The airfoil in accordance with claim 1, wherein said at least one recessed section is offset from said trailing edge within a range between and including approximately 15% and approximately 30% of said chord distance.

5. The airfoil in accordance with claim 1, wherein said at least one recessed section is offset from said leading edge within a range between and including approximately 15% and approximately 30% of the chord distance and offset from said trailing edge within a range between and including approximately 15% and approximately 30% of the chord distance.

6. The airfoil in accordance with claim 1, wherein said at least one recessed section comprises a first recessed section offset from said leading edge, wherein said first section further defines a second recessed section offset from said trailing edge, wherein said first recessed section is separate from said second recessed section.

7. The airfoil in accordance with claim 6, wherein said second recessed section extends between said at least one planar section and said pressure sidewall.

8. The airfoil in accordance with claim 1, wherein said at least one planar section comprises a pressure section adjacent said pressure side and a suction section adjacent said suction side, wherein said at least one recessed section is substantially U-shaped extending between said pressure section and said suction section.

9. The airfoil in accordance with claim 1, wherein said recessed section extends substantially perpendicular from said at least one planar section within a range between and including approximately 0.8 millimeters (mm) and approximately 1 mm.

10. The airfoil in accordance with claim 1, wherein said at least one planar section has a substantially uniform thickness except for the second thickness of said second section.

11. A turbomachine comprising:

a casing;

a rotor assembly, said casing at least partially extending about said rotor assembly, said rotor assembly comprising:

a rotor shaft; and a plurality of rotor blades coupled to said rotor shaft, each rotor blade of said plurality of rotor blades comprising an airfoil comprising a pressure sidewall and a suction sidewall coupled to said pressure sidewall, wherein said suction sidewall and said pressure sidewall define a leading edge and a trailing edge, wherein said leading edge and said trailing edge define a chord distance, said airfoil further comprising a tip portion extending between said pressure sidewall and said suction sidewall, said tip portion comprising at least one planar section, said at least one planar section comprising a first section having a first thickness and a second section having a second thickness, wherein the second thickness is substantially equal to a thickness of said airfoil, said second section located at or about a mid-chord distance between and distanced from said leading edge and said trailing edge, said first section defining at least one recessed section, said at least one recessed section extending between said at least one planar section and said suction sidewall such that said pressure sidewall extends to said at least one planar section, said at least one recessed section offset from said leading edge and said trailing edge along the chord distance, wherein the first thickness is less than the second thickness.

12. The turbomachine in accordance with claim 11, wherein a cross-sectional area of said planar section is within a range between and including approximately 40% and approximately 70% less than a cross-sectional area of said airfoil.

13. A method of assembling a turbomachine, the turbomachine including a casing, a rotor shaft, and a plurality of rotor blades, each rotor blade of the plurality of rotor blades including an airfoil including a pressure sidewall and a suction sidewall coupled to the pressure sidewall, wherein the suction sidewall and the pressure sidewall define a leading edge and a trailing edge, wherein the leading edge and the trailing edge define a chord distance, the airfoil further including a tip portion extending between the pressure sidewall and the suction sidewall, said method comprising:

forming at the tip portion at least one planar section including a first section having a first thickness and a second section having a second thickness, the second thickness substantially equal to a thickness of said airfoil, said second section located at or about a mid-chord distance between and distanced from said leading edge and said trailing edge, said first section defining at least one recessed section adjacent said at least one planar section, wherein said at least one recessed section is offset from said leading edge and said trailing edge along the chord distance, wherein the first thickness is less than the second thickness; and coupling the rotor blade to the rotor shaft such that during turbomachine operation when the tip portion contacts the casing wear of the rotor blade is reduced, wherein forming the at least one planar section further comprises removing blade material from the suction sidewall to define the at least one recessed section.

14. An airfoil for use in a turbomachine, said airfoil comprising:

a pressure sidewall;

a suction sidewall coupled to said pressure sidewall, wherein said suction sidewall and said pressure sidewall define a leading edge and a trailing edge, wherein said leading edge and said trailing edge define a chord distance; and a tip portion extending between said pressure sidewall and said suction sidewall, said tip portion comprising at least one planar section, said at least one planar section comprising a first section having a first thickness and a second section having a second thickness, wherein the second thickness is substantially equal to a thickness of said airfoil, said second section located at or about a mid-chord distance between and distanced from said leading edge and said trailing edge, said first section defining at least one recessed section, said at least one recessed section extending adjacent said at least one planar section, said at least one recessed section offset from said leading edge and said trailing edge along the chord distance, wherein the first thickness is less than the second thickness, and wherein said at least one planar section has a substantially uniform thickness except for the second thickness of said second section.

* * * * *